United States Patent [19]

Robinson

[11] 4,035,964

[45] July 19, 1977

[54] FOLDABLE ENCLOSURE

[76] Inventor: Kenneth J. Robinson, P.O. Box 86, Atlanta, Mich. 49709

[21] Appl. No.: 632,011

[22] Filed: Nov. 14, 1975

[51] Int. Cl.[2] ..... E04B 1/344

[52] U.S. Cl. ..... 52/66; 52/70; 52/71; 217/14; 296/23 G

[58] Field of Search ..... 52/69, 70, 71; 220/6; 217/14, 26; 296/23 G, 23 F, 23 H, 29

[56] References Cited

U.S. PATENT DOCUMENTS

| | | | |
|---|---|---|---|
| 923,903 | 6/1909 | Silverstein | 220/6 |
| 963,769 | 7/1910 | Johnson | 220/6 |
| 1,673,769 | 6/1928 | Graham | 220/6 |
| 1,972,483 | 9/1934 | Hartson | 220/6 |
| 2,963,122 | 12/1960 | Jagemann | 52/70 |
| 3,257,760 | 6/1966 | Calthrope | 52/71 |
| 3,527,339 | 9/1970 | Cipolla | 217/14 |
| 3,582,131 | 6/1971 | Brown | 52/66 |
| 3,648,299 | 3/1972 | Durst | 220/6 |
| 3,765,556 | 10/1973 | Baer | 220/6 |

FOREIGN PATENT DOCUMENTS

| | | | |
|---|---|---|---|
| 49,122 | 3/1931 | Norway | 220/6 |

*Primary Examiner*—Price C. Faw, Jr.
*Assistant Examiner*—Henry Raduazo
*Attorney, Agent, or Firm*—Berman, Aisenberg & Platt

[57] ABSTRACT

A foldable shed or enclosure consisting of a rear wall, a front wall including a door, centrally foldable side walls hinged at their front and rear edges to the side edges of the front and rear walls, a floor hinged to the bottom margin of the rear wall and a roof connected at rear side edge portions thereof to the upper side edge portions of the rear wall by link bars. A foldable strut bar is pivotally and swivelly connected to the top marginal portions of the front sections of the foldable side walls, the strut bar having a locking mechanism which locks its segments in horizontal positions when the side walls are unfolded to their planar positions. By raising the floor against the rear wall, unlocking the strut bar, folding the side walls inwardly and folding the roof downwardly, the shed can be folded to a compact flat condition with the roof and link bars acting to clamp the parts together.

10 Claims, 14 Drawing Figures

FIG. 3.
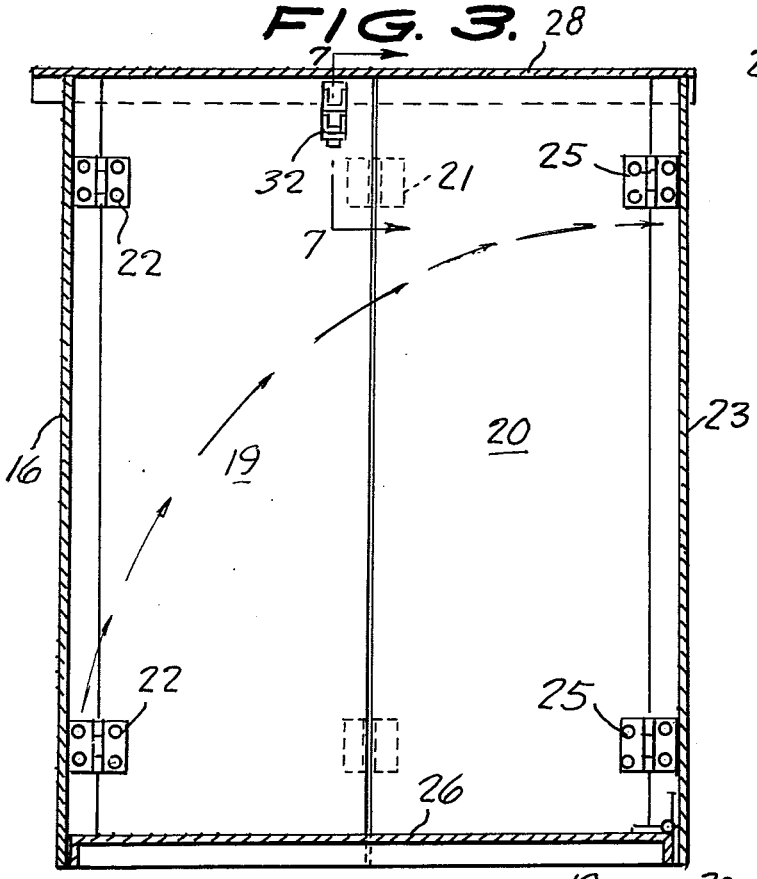
FIG. 4.
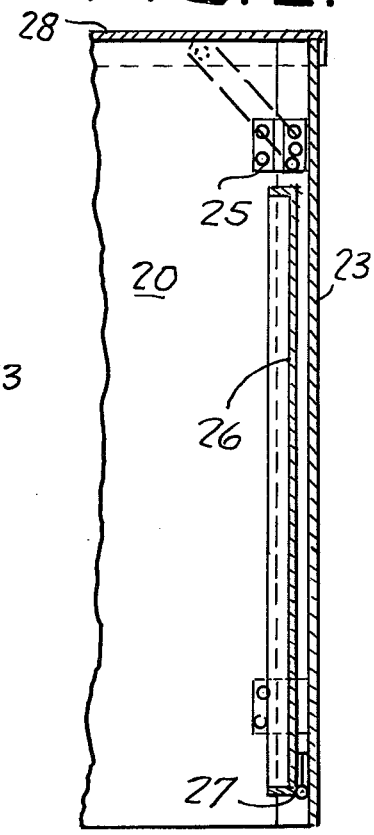
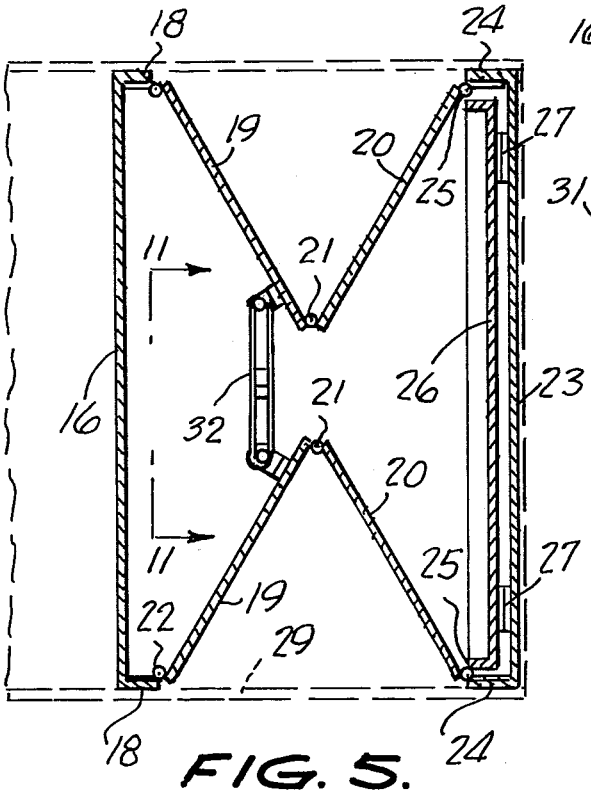
FIG. 5.
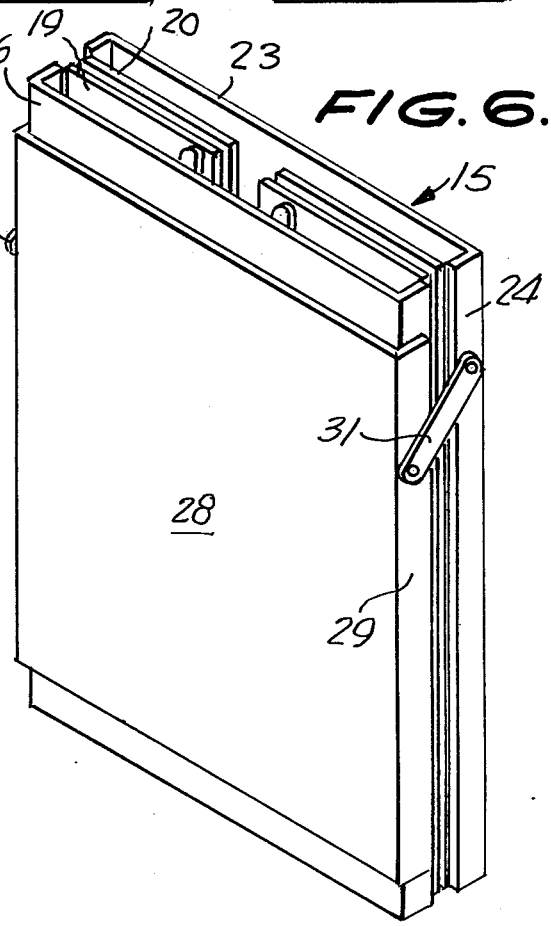
FIG. 6.

FOLDABLE ENCLOSURE

This invention relates to collapsible housing or enclosures, and more particularly to a foldable shed having a floor and roof.

A main object of the invention is to provide a novel and improved foldable shed which is simple in construction, which is easy to set up for use, and which is provided with means to lock it when it is unfolded.

A further object of the invention is to provide an improved foldable shed which can be cheaply and economically fabricated, which is sturdy in construction, which is substantially weather-proof, and which can be readily folded to a very compact size for convenient transportation and storage.

A still further object of the invention is to provide an improved foldable shed or housing which employs relatively few parts, which can be easily set up for use or collapsed for transportation or storage without requiring the use of any tools and with minimum effort, and which is useful for a wide range of purposes, such as for storing equipment, for serving as a temporary shelter for campers or outdoor workers, or for any other purpose for which a portable housing is required.

Further objects and advantages of the invention will become apparent from the following description and claims, and from the accompanying drawings, wherein:

FIG. 3 is a transverse vertical cross-sectional view taken substantially on line 3—3 of FIG. 1.

FIG. 4 is a fragmentary vertical cross-sectional view showing the floor of the shed folded against the rear wall in the first step in folding the shed.

FIG. 5 is a horizontal cross-sectional view, similar to FIG. 2, showing the side walls being folded inwardly as a further step in folding the shed.

FIG. 6 is a perspective view showing the shed in fully folded condition.

FIG. 1 is a view similar to FIGS. 13 and 14 showing the roof and associated link connection in final folded clamping position, holding the parts in the collapsed condition of FIG. 6.

Figure 1:
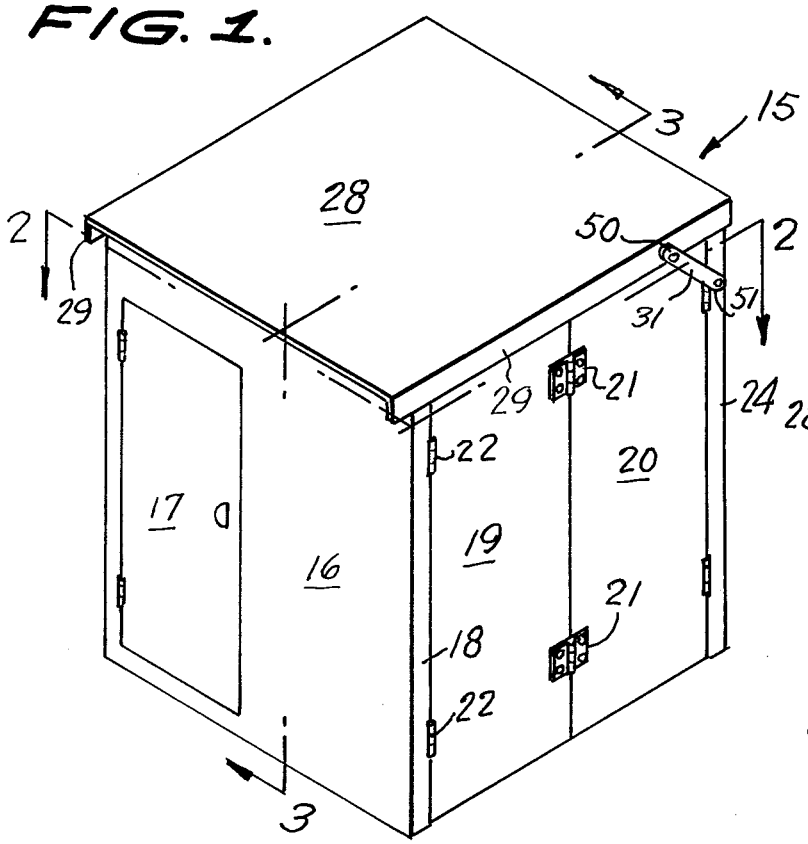
FIG. 1 is a perspective view of an improved foldable shed according to the present invention, shown set up for use.

Referring to the drawings, 15 generally designates a typical shed according to the present invention, shown set up for use in FIG. 1. The shed 15 comprises a front wall 16 including a hinged door 17, and having side flanges 18,18 at its vertical side edges. The shed has centrally hinged foldable side walls comprising half-sections 19,20 hinged at their abutting vertical edges by hinges 21,21 allowing the side walls to be folded inwardly. The front side wall sections 19 are hinged to the front wall flanges 18 by hinges 22,22. The shed has a rear wall 23 provided with side flanges 24,24 at its vertical side edges. The rear side wall sections 20 are hinged to the flanges 24 by hinges 25.

The shed has a peripherally flanged rectangular floor 26 which is hinged at its rear edge to the lower marginal portion of rear wall 23 by hinges 27,27, allowing the floor to be folded against the rear wall 23, namely, to be rotated upwardly to the vertical position thereof shown in FIG. 4.

The shed 15 has a rectangular roof member 28 which is provided with depending side flanges 29,29. Side flanges 29 are connected at their rear portions to the upper portions of rear side wall flanges 24 by respective link bars 31,31.

In the operative unfolded condition of the shed shown in FIG. 1, the upper marginal portions of flanges 18, side wall sections 19,20 and flanges 24 are received inwardly adjacent to the depending side flanges 29 of roof member 28.

Figure 7:
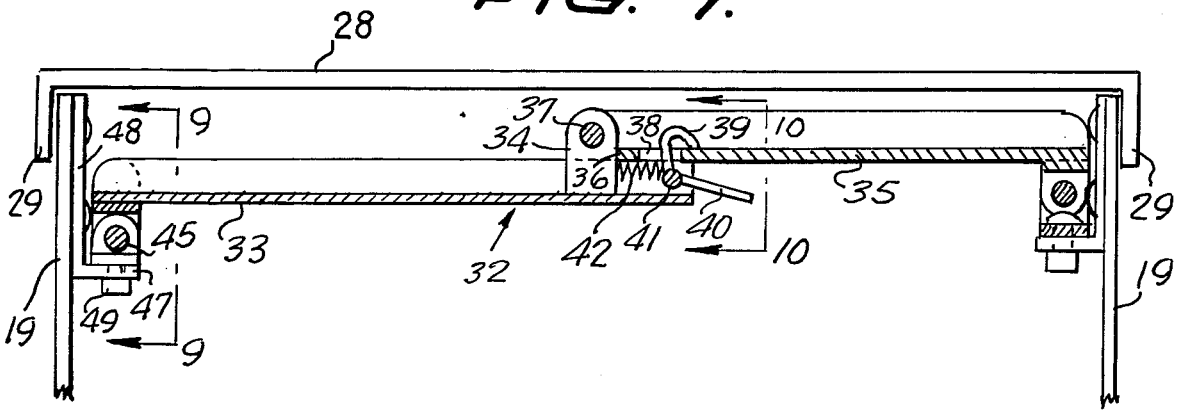
FIG. 7 is a fragmentary enlarged vertical cross-sectional view taken substantially on line 7—7 of FIG. 3, showing the brace strut member in its horizontally locked working position.
Figure 8:
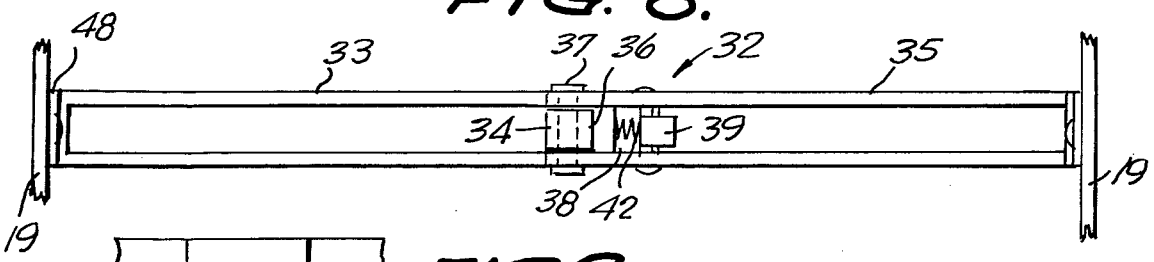
FIG. 8 is a top plan view of the brace strut member in the horizontally locked working position of FIG. 7.
Figure 9:
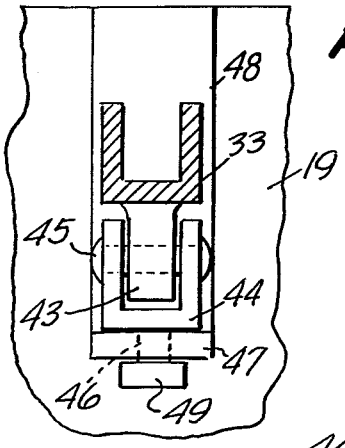
FIG. 9 is an enlarged vertical cross-sectional view taken substantially on line 9—9 of FIG. 7.
Figure 10:
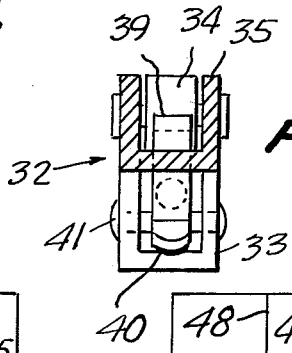
FIG. 10 is an enlarged vertical cross-sectional view taken substantially on line 10—10 of FIG. 7.
Figure 11:
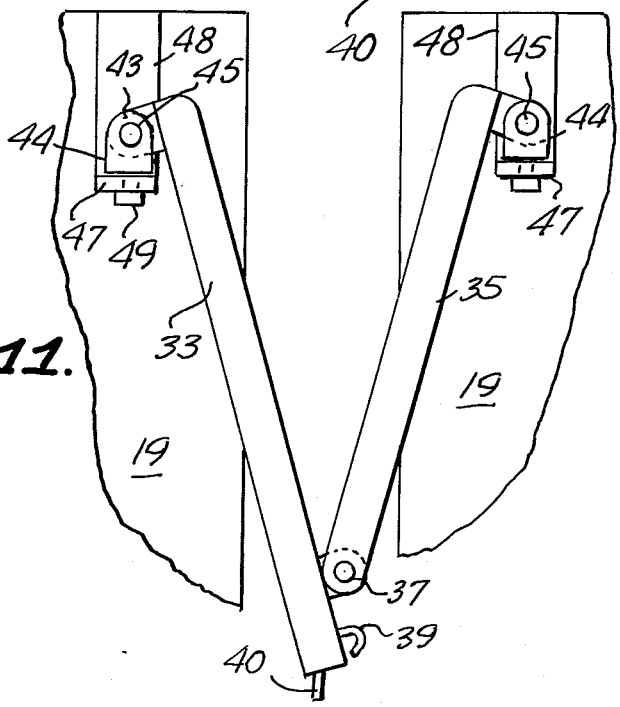
FIG. 11 is a fragmentary enlarged elevational view taken substantially on line 11—11 of FIG. 5, showing the brace strut in partially folded condition.

A foldable brace strut assembly 32 is pivotally and swivelly connected to the upper rear portions of the side wall sections 19,19. The brace strut assembly 32 comprises an upwardly facing first channel bar 33 having an upstanding lug 34 at its inner end portion. A second upwardly facing channel bar 35 is notched at 36 to receive lug 34, as shown in FIG. 8, and is pivotally connected to the top portion of the lug by a transverse pivot pin 37 extending through the projecting ends of the flanges of bar 35 and the intervening lug 34, allowing the bars 33,35 to be arranged in horizontal operative positions with the lug 34 abutting the transverse edge of the notch 36, as shown in FIG. 7. The web of bar 35 has an aperture 38 through which is engageable the upstanding hooked latch element 39 of a latch lever 40 pivoted at 41 between the end portions of the flanges of bar 33. A coiled spring 42 bears between lug 34 and latch element 39, biasing said latch element clockwise, as viewed in FIG. 7, namely, toward locking position relative to aperture 38. When the cooperating brace bars 33,35 are elevated toward horizontal positions the hook-shaped latch element 39 enters and is at first cammingly rotated counterclockwise by aperture 38 against the force of spring 42, after which the hook element slips upwardly through the aperture and becomes lockingly engaged on the upper surface of the web of bar 35, as shown in FIG. 7, retaining the bars 33,35 in horizontal extended positions. The bars 33,35 may be unlocked to allow them to rotate downwardly by manually rotating lever 40 counterclockwise against the force of spring 42 sufficiently to allow latch element 39 to pass downwardly through the aperture 38.

The outer ends of the brace bars 33,35 are pivotally and swivelly connected to the side wall sections 19 in the manner illustrated in FIGS. 7,9, 10 and 11. Thus, bar 33 has a depending lug 43 (FIG. 9) which is pivoted in a yoke member 44 for rotation on a horizontal pin 45 secured in the spaced upstanding arms of the yoke member. The yoke member 44 has a depending vertical stem 46 extending through the horizontal flange 47 of an L-shaped bracket 48 rigidly secured to the adjacent side wall section 19. Stem 46 has an enlarged bottom retaining head 49 below flange 47.

The other brace bar 35 is pivotally and swivelly connected to the opposite side wall section 19 in a similar manner. The swivel connections allow the folding brace bars to follow the inward movement of the side wall sections 19,19 when the shed is folded, as will be presently described.

Figure 12:
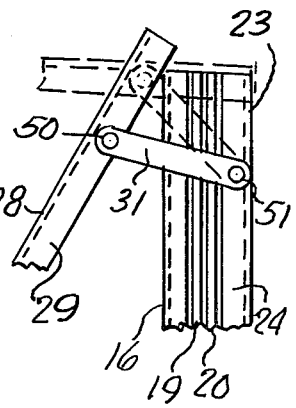
FIG. 12 is a fragmentary elevational view showing the link-connected roof member at the beginning of its downward movement toward folded position.
Figure 13:
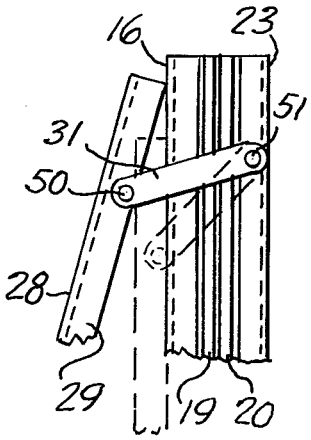
FIG. 13 is a view similar to FIG. 12 showing the subsequent downward movement of the roof linkage toward folded position of the roof.
Figure 2:
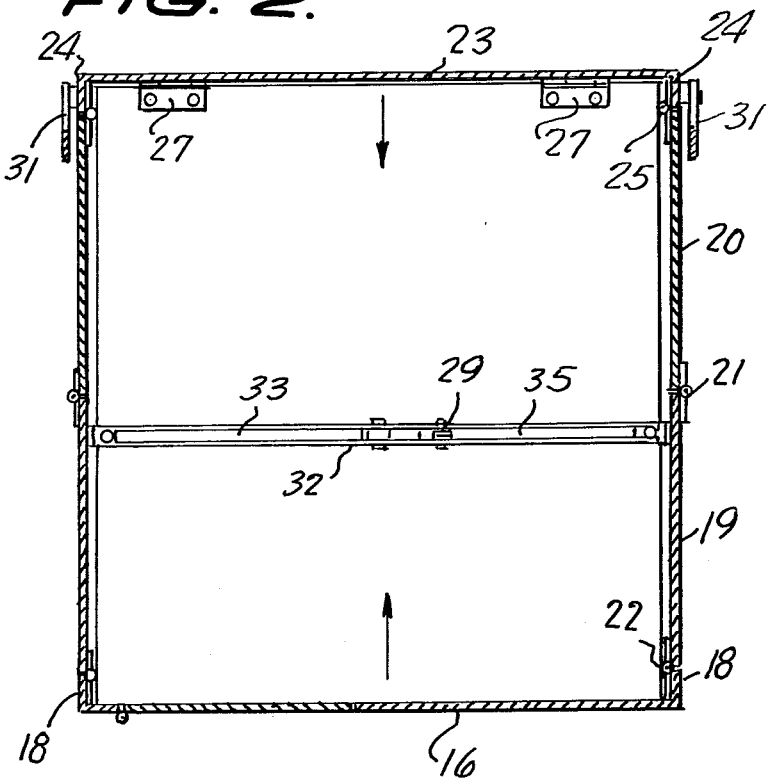
FIG. 2 is a horizontal cross-sectional view taken substantially on line 2—2 of FIG. 1.
Figure 14:
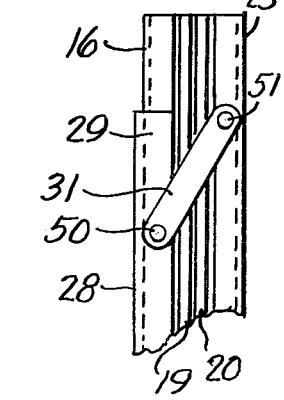

In folding the shed to its collapsed position shown in FIG. 6, the floor member 26 is first folded upwardly (access thereto being provided through the door 17, which is opened) to the upright position of the floor member shown in FIG. 4. The brace strut assembly 32 is then unlocked by rotating lever 40 upwardly, allowing the bars 33 and 35 to rotate downwardly and allowing the side walls to be folded inwardly in the manner shown in FIG. 5. Front wall 16 is then brought as close as possible to rear wall 23, and roof member 28 is then swung downwardly from its original position progressively as shown in FIGS. 12, 13 and 14. The link bars 31 are pivotally connected to points 50,51 on the flanges 29,24 spaced from the ends of the flanges sufficiently to allow the rear edge of roof member 28 to clear the top edge of front wall 16 (as in FIG. 12), to then allow the roof member to continue its descent (as in FIG. 13) and to then allow the roof member to reach a final vertical position (as in FIG. 14) with the front wall 16 nestingly received between flanges 29,29 and with the roof member exerting clamping pressure on the elements between rear wall 23 and said roof member because of the connections of the suspension link bars 31,31. This provides the flat folded package illustrated in FIG. 6.

The shed is unfolded to the operative condition thereof shown in FIG. 1 by following a procedure reverse to that above described. By exerting upward manual force on the inner end of the brace bar 33, the side wall sections 19, 20 may be forced into substantially coplanar relation and will be locked against the depending flanges 29,29 of the roof member 28, the brace bar elements 33 and 35 being locked in horizontal positions by the locking coaction of the latch member 39 with the aperture 38, as above described. The floor member 26 may be lowered to horizontal position after the brace strut assembly 32 is locked.

While a specific embodiment of an improved foldable shed has been disclosed in the foregoing description, it will be understood that various modifications within the spirit of the invention may occur to those skilled in the art. Therefore it is intended that no limitations be placed on the invention except as defined by the scope of the appended claims.

What is claimed is:

1. A foldable enclosure comprising a front wall, a rear wall, respective opposite foldable side walls hinged to the side edges of said front and rear walls, each side wall comprising a plurality of vertically hinged, inwardly swingable sections, a floor member hinged to the bottom marginal portion of said rear wall and being foldable upwardly to an upright position substantially parallel to and adjacent to said rear wall, a roof member, and means swingably connecting said roof member to the opposite side edges of said rear wall so that said roof member can be at times folded to a position parallel to said rear wall with the floor member, folded side walls and front wall interposed between the roof member and said rear wall, said swingable connecting means including means for holding down said roof member when said enclosure is in its unfolded position and for exerting a clamping force between said rear wall and said roof member when said enclosure is in its folded position, and wherein said swingable connecting means comprises a pair of link bars diagonally connecting the rear portions of the side edges of the roof member to the upper portions of the side edges of the rear wall, so as to provide said holding down and clamping actions.

2. The foldable enclosure of claim 1, and wherein said roof member and rear wall are provided with side flanges and said link bars are connected to said side flanges respectively of the roof members and rear wall.

3. The foldable enclosure of claim 2, and wherein said foldable side walls each comprises a forward section and a rearward section hinged together and foldable inwardly.

4. The foldable enclosure of claim 3, and wherein said forward and rearward side wall sections are unfoldable to substantially flush configurations located inwardly adjacent to said roof member side flanges.

5. A foldable enclosure comprising a front wall, a rear wall, respective opposite foldable side walls hinged to the side edges of said front and rear walls, each side wall comprising a plurality of vertically hinged, inwardly swingable sections, a floor member hinged to the bottom marginal portion of said rear wall and being foldable upwardly to an upright position substantially parallel to and adjacent to said rear wall, a roof member, and means swingably connecting said roof member to the opposite side edges of said rear wall so that said roof member can be at times folded to a position parallel to said rear wall with the floor member, folded side walls and front wall interposed between the roof member and said rear wall, and brace strut means connected between a pair of opposed inwardly swingable sections of said foldable side walls, comprising a pair of brace bars, means pivotally and swivelly connecting said brace bars respectively to the opposed inwardly swingable side wall sections and means pivotally connecting said brace bars at their inner ends, so that said brace strut means is foldable when said inwardly swingable sections move inwardly towards each other.

6. The foldable enclosure of claim 5, and means to lock the brace bars in substantially horizontal positions to hold the sections of the side walls in substantially coplanar unfolded relationship.

7. The foldable enclosure of claim 6, and wherein said locking means comprises a latch element on one of the brace bars and means on the other brace bar lockingly engageable with said latch element when the brace bars are moved toward horizontal positions.

8. The foldable enclosure of claim 7, and wherein said one of the brace bars is provided with spring means urging said latch element toward locking position and the locking means on the other brace bar comprises an aperture formed in said other brace bar and located to cammingly interengage with said latch element and to allow the latch element to pass therethrough and move to locking position when the brace bars reach substantially horizontal positions.

9. The foldable enclosure of claim 8, and wherein the means pivotably and swivelly connecting the brace bars to the opposed side wall sections comprises respective yoke members vertically pivoted to the side wall sections, and horizontal pin means pivotally connecting the outer ends of the brace bars to said yoke members.

10. A foldable enclosure comprising a front wall, a rear wall, respective opposite foldable side walls hinged to the side edges of said front and rear walls, each side wall comprising a plurality of vertically hinged, inwardly swingable sections, a floor member hinged to the bottom marginal portion of said rear wall and being foldable upwardly to an upright position substantially parallel to and adjacent to said rear wall, a roof member, and means swingably connecting said roof member to the opposite side edges of said rear wall so that said roof member can be at times folded to a position parallel to said rear wall with the floor member, folded side walls and front wall interposed between the roof member and said rear wall, and brace strut means connected between a pair of opposed inwardly swingable sections of said foldable side walls and foldable inwardly of said side walls, so that when said enclosure is folded said brace strut means is enclosed between said roof member and said rear wall.

* * * * *